United States Patent [19]

Astley et al.

[11] 4,264,819

[45] Apr. 28, 1981

[54] SPUTTERED PARTICLE FLOW SOURCE FOR ISOTOPICALLY SELECTIVE IONIZATION

[75] Inventors: Eugene R. Astley; Harold K. Forsen, both of Bellevue, Wash.

[73] Assignee: Jersey Nuclear-Avco Isotopes, Inc., Bellevue, Wash.

[21] Appl. No.: 885,997

[22] Filed: Mar. 13, 1978

Related U.S. Application Data

[60] Continuation of Ser. No. 682,258, May 3, 1976, abandoned, which is a division of Ser. No. 428,662, Dec. 27, 1973, Pat. No. 3,955,090.

[51] Int. Cl.[2] ..... H01J 39/34

[52] U.S. Cl. ..... 250/423 P; 250/281

[58] Field of Search ..... 250/423 P, 281, 282, 250/423 R; 331/94.5 C, DIG. 1, 94.5 G

[56] References Cited

U.S. PATENT DOCUMENTS

| | | | |
|---|---|---|---|
| 3,464,026 | 8/1969 | Woodbery et al. | 331/94.5 C |
| 3,504,297 | 3/1970 | Labuda | 331/94.5 G |
| 3,558,877 | 1/1971 | Pressman | 250/251 |
| 4,035,638 | 7/1977 | Szöke et al. | 250/251 |

FOREIGN PATENT DOCUMENTS

| | | | |
|---|---|---|---|
| 2312194 | 10/1973 | Fed. Rep. of Germany | 250/423 P |

*Primary Examiner*—Bruce C. Anderson

*Attorney, Agent, or Firm*—Weingarten, Maxham & Schurgin

[57] ABSTRACT

Method and apparatus for sputtering particles of plural isotope types to produce a particle flow of the plural isotope types into a region where laser radiation is generated to produce isotopically selective ionization of at least one isotope type in the sputtered particle flow. Separate collection of the ionized particles is accomplished through application of a magnetic field in the region of ionization and beyond.

6 Claims, 6 Drawing Figures

FIG. 3
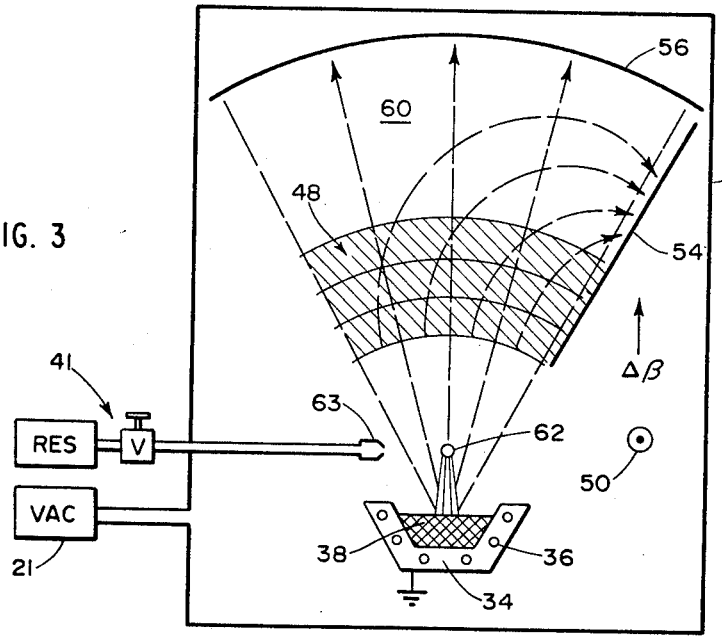
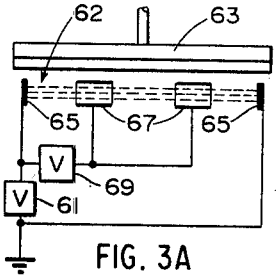
FIG. 3A
FIG. 4
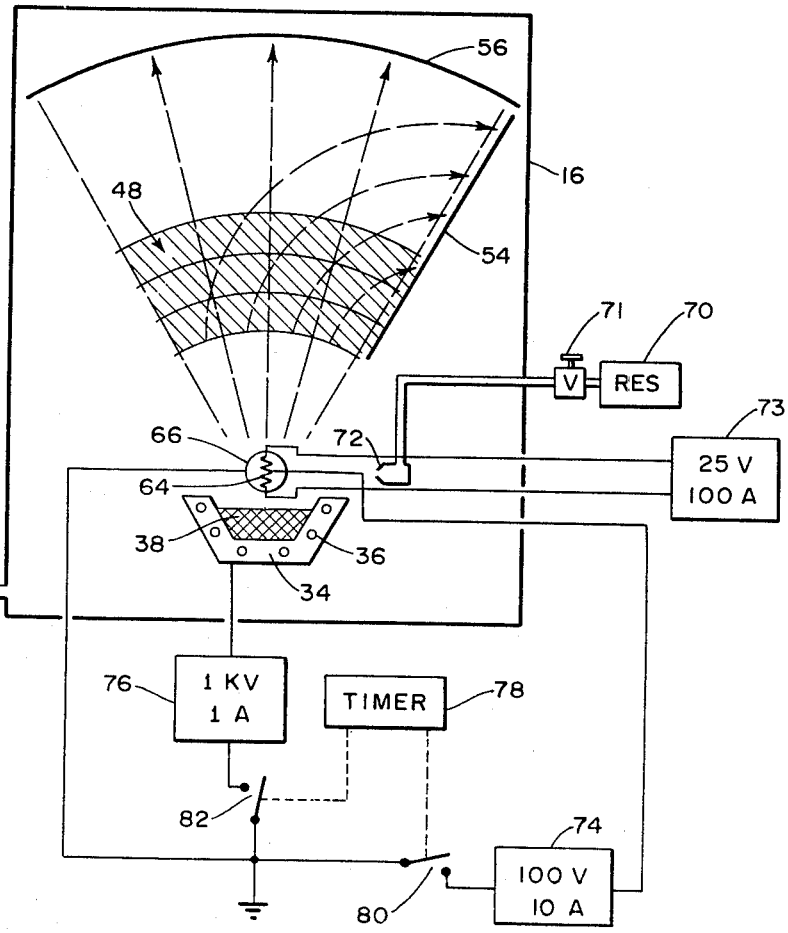
FIG. 4A
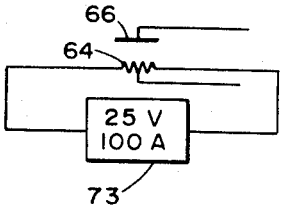

SPUTTERED PARTICLE FLOW SOURCE FOR ISOTOPICALLY SELECTIVE IONIZATION

CROSS REFERENCE TO RELATED APPLICATIONS

This application is a continuation of U.S. patent application Ser. No. 682,258 filed May 3, 1976, now abandoned, which is a division of U.S. patent application Ser. No. 482,662, filed Dec. 27, 1973, now U.S. Pat. No. 3,955,090.

FIELD OF THE INVENTION

This invention relates to isotope separation and in particular to method and apparatus for producing a flowing environment of plural isotopes by sputtering.

BACKGROUND OF THE INVENTION

A promising technique for isotope separation, and more particularly for uranium enrichment, operates by the application of laser radiant energy in preferably two or more photon wavelengths to a vapor flow of the uranium particles in such a manner as to selectively photoionize the uranium particles of one isotope type without corresponding photoionization of particles of other isotope types. The selectively photoionized particles are then typically accelerated onto trajectories for separate collection by application of crossed-field magnetohydrodynamic techniques. The plural isotopes of uranium may typically be vaporized from an elemental state by heating to produce a particle flow into the region of selective photoionization and beyond. See, for example, U.S. Pat. No. 3,772,519.

In providing an efficiently operative system according to this principle, a trade-off may be balanced between the rate of uranium evaporation and corresponding particle flow density and the loss in efficiency resulting from atom-atom scattering and from charge exchange reactions. Atom-atom scattering involves particle flow deflections as a result of collisions and charge exchange reactions occuring between neutrals and selectively ionized particles to permit loss of desired particles and collection of undesired particles. Both of these effects become more damaging as the particle flow density increases. In addition, since the crossed-field magnetohydrodynamic forces are applied to all charged particles in the environment, particles which have become ionized through processes other than selective photo-ionization will be deflected and collected along with the enriched uranium isotope thereby also diluting the yield. Moreover, particles may exist in the particle flow in excited but un-ionized states and thus fail to be photoionized unless additional laser frequencies are employed.

BRIEF SUMMARY OF THE INVENTION

In accordance with the preferred embodiment of the present invention a system for isotopically selective ionization is disclosed wherein a particle flow of typically uranium particles is generated by momentum transfer or sputtering. The generation of a particle flow by sputtering yields a high velocity particle flow permitting low densities for high material processing rates and may reduce the percentages of particles ejected into the flow in elevated or ionized energy conditions.

In typical apparatus employed for practicing the present invention, a reservoir of metallic uranium is exposed to a stream of ions of an inert gas created and accelerated by arc discharge or triode sputtering techniques. A low pressure atmosphere of an inert gas is provided for this purpose and, with practical sputtering yields, can be effective to produce useful levels of sputtering uranium flow rates without having the inert gas interfere with the processes of isotope separation.

A region of the sputtered particle flow is illuminated with precisely tuned laser radiation to produce selective excitation and ionization of particles of one isotope type, typically $U_{235}$, without corresponding ionization of particles of other isotope types. The relatively high particle velocity resulting from sputtering makes it desirable to apply each burst of laser radiation over a substantial length of the flow direction by, for example, multiple reflections of the beam. Once selective ionization of the desired isotope type has been achieved, the ionized particles are separated from the sputtering particle flow by application of a magnetic field or a magnetic field gradient to deflect the ions onto trajectories enabling their collection apart from the particle flow.

BRIEF DESCRIPTION OF THE DRAWINGS

These and other features of the present invention will be more fully understood by reference to the detailed description of the preferred embodiment presented below for purposes of illustration and not by way of limitation and to the accompanying drawings of which:

FIG. 3 is an internal view of a portion of the apparatus of FIG. 1 showing an alternative form for practicing isotope separation from a sputtered particle flow according to the invention;

FIG. 3A shows an overhead view of a portion of the FIG. 3 apparatus;

FIG. 4 is an internal view of a portion of the FIG. 1 apparatus showing a further alternative form for practicing the invention; and FIG. 4A is a side view of a portion of the apparatus of FIG. 4.

DETAILED DESCRIPTION OF THE PREFERRED EMBODIMENT

In the preferred embodiment of the present invention method and apparatus are contemplated for generating an environment of flowing particles of plural isotope types by sputtering, a process of physically ejecting particles from a lattice surface by momentum transfer from impacting ions to the lattice with lattice particles ejected on recoil. The sputtered particle flow has characteristics which improve the efficiency of subsequent selective ionization and collection of one isotope type in the flowing environment.

The preferred form of the invention is intended for use with uranium enrichment, particularly enrichment of the $U_{235}$ isotope of uranium but it is contemplated that the system of the invention may be employed for isotope separation of other elements or compounds. In the preferred embodiment, photoionization is achieved with two frequencies or photon energies of laser radiant energy, but it is contemplated that the invention may be used with a single frequency or several frequencies as may be desired or appropriate.

Figure 1:
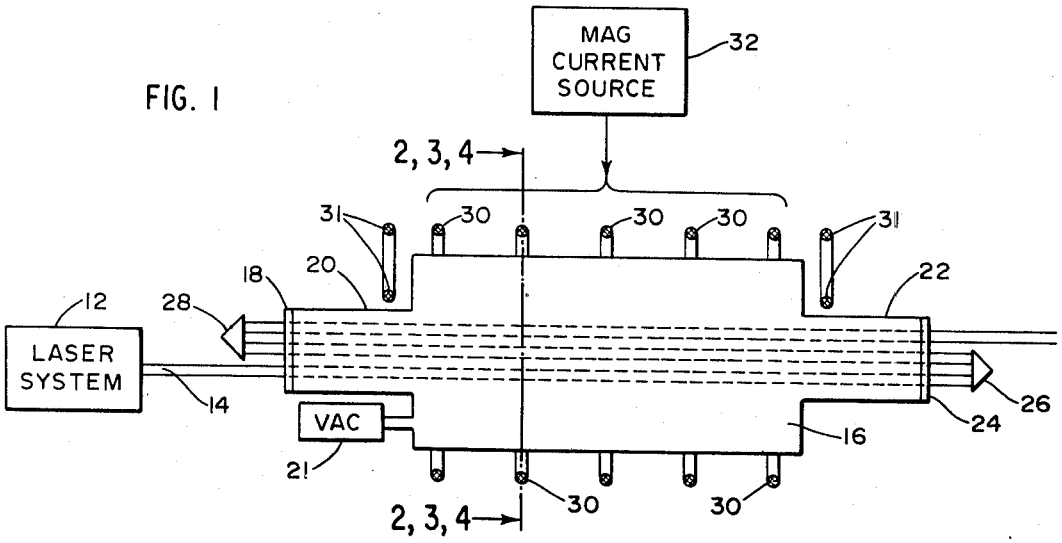
FIG. 1 is a system diagram of apparatus for use in the invention.

In describing the invention in the context of a preferred system for uranium enrichment, reference is made to the apparatus for achieving this result in FIG. 1 which includes a laser system 12 such as, for example, shown in U.S. Pat. No. 3,772,519, specifically incorporated herein by reference. The laser system 12 will provide an output beam 14 of pulses or bursts of laser radiant energy containing typically two photon energies achieved by combining the outputs of two laser systems such as the Dial-A-Line lasers of the Avco Everett Research Laboratory, Everett, Mass., by a dichroic mirror or a prism. At least one of the photon energies is of a very narrow bandwidth, facilitated by the use of gratings, prisms or etalon filters as found necessary, and tuned to correspond precisely to an absorption line for the isotope to be separated, typically uranium $U_{235}$. Such an absorption line may be selected from the literature. The second laser photon energy will be selected with an energy sufficient to ionize the excited $U_{235}$ and is generally less critical in tune.

The bursts of laser radiant energy in the beam 14 are applied to an evacuated chamber 16 through a window 18 on a pipe 20. The chamber 16 is kept at a low pressure, approximately 0.01–0.1 millitorr, by a vacuum pump 21. The pipe 20 permits placement of the window 18 at a point where contamination of the window is reduced. The laser beam 14 may exit the chamber 16 through a further pipe 22 and window 24 to be used in subsequent chambers to provide more complete utilization of the energy in the beam. A set of prisms 26 and 28 may be employed to provide multiple traversals of the beam 14 through the chamber 16 so as to cover a greater area with laser illumination within the chamber 16 for purposes to be explained below.

A set of coils 30 surrounds the chamber 16 to provide an axial magnetic field within the chamber generally parallel to the direction of laser beam 14. The magnetic field is typically in the range of 0.5–1.0 Kgauss and is excited from a magnetic current source 32. The coils may be cooled in any suitable manner known in the art. Coils 31 may be optionally added to provide a field gradient as will be described below.

Figure 2:
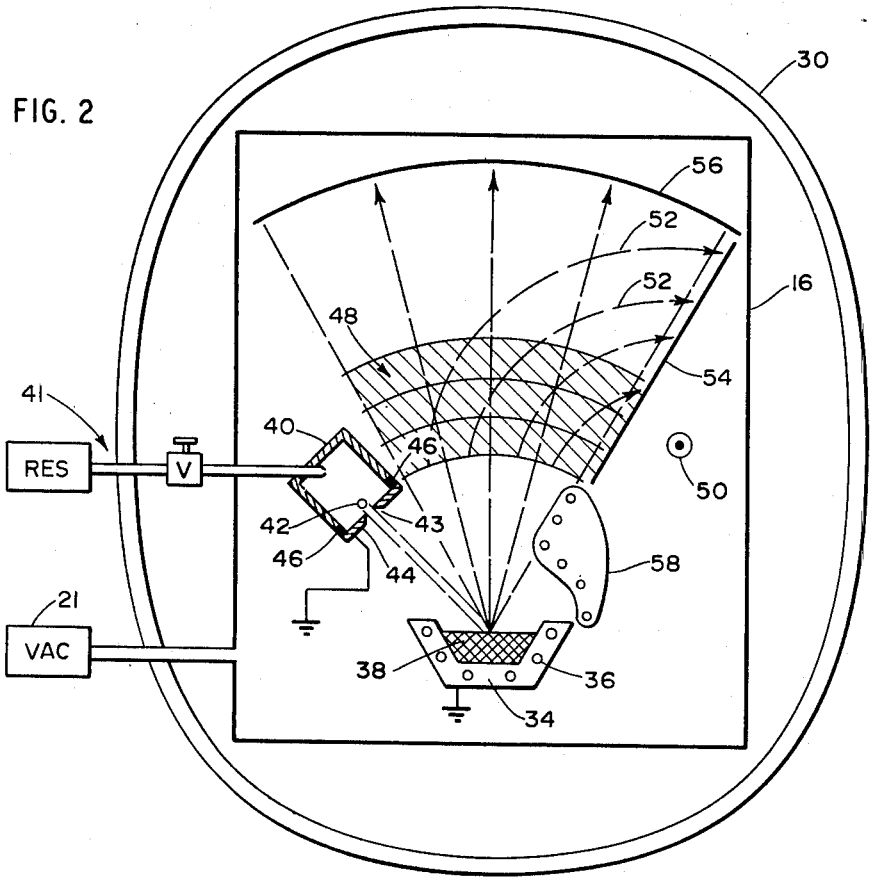
FIG. 2 is an internal view of a portion of the apparatus of FIG. 1 showing one form for practicing isotope separation from a sputtered particle flow according to the invention.

With reference to FIG. 2, there is shown an internal view of the chamber 16 generally along cut-away lines indicated in FIG. 1. The apparatus of FIG. 2 within the chamber 16 extends substantially the axial length of the chamber in the indicated configuration. The view of FIG. 2 may be slightly smaller than actual size as an example of scale, but not a limitation on size.

With reference now to FIG. 2, there is contained within the chamber 16 a crucible 34 having a plurality of cooling ports 36 and containing a mass of uranium metal 38. A separate chamber 40 provides a high perveance ion source with an internal arc discharge 42 operated at approximately 30 KV. above ground potential. A source 41 of an inert gas such as xenon supplies the gas through a leak valve to a jet within chamber 40 to maintain typically 1–100 millitorr of pressure. The magnetic field from coils 30 stabilizes the arc discharge 42 of gas within chamber 40. A front plate 44 of the chamber 40 is connected to ground and has a slit 43 through which the ions produced in the arc discharge and accelerated by the potential between the 30 KV. positive potential at the arc discharge and the plate 44 pass and are directed toward an axial line on the surface of the uranium mass 38. The remaining walls of chamber 40 are insulated from grounded plate 44 by insulators 46. The ions impacting on the surface of the uranium mass 38 create a momentum transfer which results in recoil ejection of a number of uranium atoms for each incident sputtering ion. The number of sputtered atoms per incident particle defines the sputtering yield. The sputtered uranium atoms will have a generally cosine distribution with a peaked center and accordingly create a particle flow upward into a region 48 where laser radiation is applied to produce selective photoionization of the $U_{235}$ atoms in the sputtered particle flow. These selectively ionized particles will be induced by the magnetic field 50, resulting from current in coils 30, to curve on trajectories 52 which direct them for collection onto a plate 54. The particles in the sputtered flow which are not ionized and accordingly not curved in the magnetic field 50 continue onto a rear collection plate 56. A cooled shield 58 may be employed to cast a shadow of un-ionized particles at one edge of the sputtered flow over the plate 54.

Taking an exemplary flow rate of 2.5 grams per secondmeter in the sputtered particle flow commensurate with the exemplary dimensions indicated in FIG. 2 and a surface ejection rate of a few milligrams per cm., and assuming an approximate sputtering yield of twenty-five uranium atoms for each incident ion after acceleration through the 30 KV. potential, an ion current of approximately 270 ma./cm$^2$ is desired. The repetition rate for the applied laser radiation will be dependent upon the height of the region 48 if all portions of the particle flow are to be illuminated at least once. If beam 14 illuminates a subregion two centimeters high, a repetition rate of 300 $KH_z$ may be desired, but by using the multiple reflection techniques of FIG. 1 through the prisms 26 and 28, it is possible to reduce this repetition rate to approximately 100 $KH_z$ or less if further reflections are employed. To achieve this preferred repetition rate in the laser system, it may be desirable to employ plural parallel lasers which are sequentially activated with their respective outputs combined by rotating optics.

A relatively high velocity of the sputtered particles of approximately $6\times10^5$ cm/sec (generally in the range of $1\text{–}10\times10^5$ cm/sec) gives them a relatively low density compared to other forms of vapor generation and increases the mean-free path for charge exchange reactions in the selectively photoionized particles. Typical particle densities under the above conditions in region 48 are approximately $7\times10^{13}$ atoms/cm$^3$. For the dimensions indicated, the mean-free path may typically be several centimeters. The longer the mean-free path, the more efficient will the system be in collecting $U_{235}$ by insuring that more $U_{235}$ particles arrive at the plate 54 before a charge exchange reaction results in the production of $U_{238}$ ions which may then also be attracted to the plate 54. The lower density also reduces the random atom-atom collisions which would produce a particle scattering and loss of separation efficiency.

An alternative shown in FIG. 3 employs a magnetic field having a gradient which increases the intensity of the field in a region 60 directly above the photoionization region 48 to, for example, 2 Kgauss. The stronger magnetic field there reduces the radius of the deflected ions and more rapidly directs them toward the plate 54. This gradient also minimizes the magnetic field strength in the region 48 and reduces Zeeman effects there. The magnetic field gradient or increased field may be provided by the coils 31 shown in FIG. 1, or by increasing the current in the upper portions of coils 30.

Also shown in FIG. 3 is a modification in the sputtering apparatus. An arc discharge 62 is positioned directly above the metallic uranium reservoir 38 and supplied by an inert gas through a manifold from source 41. The crucible 34 is grounded with respect to a plus 30 KV. potential maintained at the arc discharge 62. A top view of discharge 62 is shown in FIG. 3A and comprises cathodes 65 at either end of the discharge and rings 67 surrounding the discharge and maintained at plus a few hundred volts by a source 69. A source 61 maintains discharge 62 at plus 30 KV. above ground. Electrons oscillate between cathodes 65 along the lines from field 50 ionizing particles in the process.

In FIG. 4, a further alternative is shown wherein the sputtering apparatus is provided in a typical triode arrangement. On respective sides of the space directly above crucible 34 are positioned a filament 64 and an anode electrode 66. The entire chamber 16 is evacuated through a vacuum pump 21 and a leak valve 69 for a source 70 of inert gas provides gas to a manifold 72 in the chamber such that the region between anode 66 and filament 64 contains a low pressure supply of inert gas atoms. FIG. 4A shows a side view of the filament 64 and anode 66. The total arc distance between filament 64 and anode 66 may have to be less than the arc distance in the FIG. 3 embodiment. In this case, a shorter chamber and/or more stages of arc discharge may be used. The filament 64 is activated, typically by a 25 volt, 100 amp. power supply 73 to emit electrons which are accelerated, for example, by a 100 volt, 10 amp. power supply 74 toward the anode 66. The moving electrons will ionize molecules of the inert gas which may then be accelerated toward the metallic uranium 38 in crucible 34 through a KV. potential difference at 1 amp. provided by a power supply 76. Typically, the voltages supplied by power supplies 74 and 76 are controlled in a sequence by a timer 78 such that a switch 80 is initially closed to connect the power supply 74 to a common ground terminal to which the anode 66 is also connected. After an interval sufficient to produce a number of ions of the inert gas, the switch 80 is opened and a switch 82 is closed which grounds the 1 KV. power supply 76, producing a negative potential on the crucible 34 with respect to the potential of the ionized inert gas particles. These particles will then be drawn toward the uranium mass 38 and eject or sputter surface uranium particles.

The timing system of FIG. 4 may also be utilized in FIG. 3. The apparatus of FIGS. 3 or 4 for sputtering is particularly useful in achieving high sputtering densities to increase the yield of the system without exceeding limits specified by mean-free path for charge exchange reactions. The various forms of the invention in FIGS. 2, 3 and 4 may be interchanged as, for example, by using arc discharge 62 in FIGS. 2 or 4 as the source for sputtering ions.

In summary, the above-described forms of the invention for isotope separation in a sputtered particle flow provide the advantages of a low density, high velocity particle flow which permits high processing rates without the collisional scattering and charge exchange effects that would be associated with higher densities. The reduction in density over evaporative apparatus may be by a factor of ten for equivalent processing rates.

It is to be understood that once the sputtered particles have been ionized, they may be separated by means other than a magnetic field such as MHD forces, an example of which is shown in the above-referenced U.S. Pat. No. 3,772,519.

Having described above the preferred embodiment for the present invention, it will occur to those skilled in the art that various alternatives and modifications can be provided within the spirit of the invention. It is accordingly intended to limit the invention only as indicated in the following claims.

What is claimed is:

1. In a system for providing isotopically selective photoexcitation of an environment of particles having plural isotope types, a system for applying excitation energy to said environment comprising:

a source of electromagnetic radiation having a radiation characteristic capable of producing isotopically selective photoexcitation of particles of a selected isotope type in said environment of particles having plural isotope types;

said source of electromagnetic radiation including means for providing said radiation as a unitary radiation beam of pulsed radiation;

means for generating said environment of particles having plural isotope types as a flow of particles; and means for applying each pulse of the unitary radiation beam repeatedly through said environment by reflection through separate regions thereof, each region defining a separate volume of said environment of particles whereby said unitary radiation beam illuminates a total volume of said environment which is a multiple of the volume of each said region.

2. The system of claim 1 wherein said means for repeatedly applying said radiation beam through said environment includes a plurality of reflectors placed outside said environment to receive said beam of radiation after passing through said environment and redirect it back through said environment.

3. The system of claim 2 wherein said plurality of reflectors includes a plurality of prisms.

4. The system of claim 2 further including:

a chamber containing said environment; and a plurality of windows transmitting the repeatedly applied radiation between said plurality of reflectors and said environment.

5. The system of claim 1 wherein said means for repeatedly applying said radiation beam through said environment includes means for applying said radiation beam in a plurality of generally parallel regions, each separated from the other in the flow direction of said flow of particles.

6. The system of claim 1 wherein said source of electromagnetic radiation provides said unitary beam at a pulse rate to provide illumination of all portions of said particle flow environment in sequential pulses of said unitary beam.

* * * * *